US008177352B2

(12) United States Patent
Fioravanti et al.

(10) Patent No.: US 8,177,352 B2
(45) Date of Patent: May 15, 2012

(54) DRUM MAINTENANCE SYSTEM FOR REDUCING DUPLEX DROPOUT

(75) Inventors: Alexander J. Fioravanti, Penfield, NY (US); Paul John McConville, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 428 days.

(21) Appl. No.: 12/535,064

(22) Filed: Aug. 4, 2009

(65) Prior Publication Data

US 2011/0032288 A1 Feb. 10, 2011

(51) Int. Cl.
*B41J 2/01* (2006.01)

(52) U.S. Cl. ..... 347/103; 347/105; 347/106; 347/101; 347/21; 347/22

(58) Field of Classification Search ..... 347/103, 347/105, 106, 101, 21, 22
See application file for complete search history.

(56) References Cited

U.S. PATENT DOCUMENTS

| | | | | |
|---|---|---|---|---|
| 5,937,257 | A | 8/1999 | Condello et al. | |
| 6,016,409 | A | 1/2000 | Beard et al. | |
| 6,196,675 | B1 * | 3/2001 | Deily et al. | 347/103 |
| 6,921,064 | B2 | 7/2005 | Rousseau | |
| 7,036,920 | B2 | 5/2006 | Rousseau et al. | |
| 7,393,312 | B2 | 7/2008 | Rousseau | |
| 2003/0165630 | A1 * | 9/2003 | Baker et al. | 427/428 |
| 2005/0133975 | A1 | 6/2005 | Rousseau | |
| 2007/0146459 | A1 * | 6/2007 | Gault et al. | 347/103 |
| 2010/0053261 | A1 | 3/2010 | Thayer et al. | |
| 2010/0053292 | A1 | 3/2010 | Thayer et al. | |

OTHER PUBLICATIONS

EP Search Report corresponding to European Patent Application 10171693.4, European Patent Office, Rijswijk Netherlands, Oct. 19, 2010 (8 pages).

* cited by examiner

*Primary Examiner* — Matthew Luu
*Assistant Examiner* — Henok Legesse
(74) *Attorney, Agent, or Firm* — Maginot, Moore & Beck, LLP

(57) ABSTRACT

A drum maintenance system for use in an imaging device includes a reservoir having a supply of release agent, and an applicator configured to receive release agent from the reservoir and to apply the release agent to an intermediate imaging surface of an imaging device. A first metering blade is positioned in wiper mode at a first position adjacent the intermediate imaging surface and configured to meter the release agent on the intermediate imaging surface applied by the applicator. A second metering blade is positioned in wiper mode at a second position adjacent the intermediate imaging surface. The system includes a second metering blade positioning system operably coupled to the second metering blade and configured to move the second metering blade into engagement with the intermediate imaging surface to further meter release agent applied to the intermediate imaging surface by the applicator when printing a first side of a duplex print job and out of engagement with the intermediate imaging surface when printing simplex print jobs and when printing a second side of a duplex print job.

20 Claims, 11 Drawing Sheets

DRUM MAINTENANCE SYSTEM FOR REDUCING DUPLEX DROPOUT

TECHNICAL FIELD

This disclosure relates generally to imaging devices having intermediate imaging surfaces, and, in particular, to maintenance systems for such intermediate imaging surfaces.

BACKGROUND

In solid ink imaging systems having intermediate members, ink is loaded into the system in a solid form, either as pellets or as ink sticks, and transported through a feed chute by a feed mechanism for delivery to a heater assembly. A heater plate in the heater assembly melts the solid ink impinging on the plate into a liquid that is delivered to a print head for jetting onto an intermediate transfer member which may be in the form of a rotating drum, for example. In the print head, the liquid ink is typically maintained at a temperature that enables the ink to be ejected by the printing elements in the print head, but that preserves sufficient tackiness for the ink to adhere to the intermediate transfer drum. In some cases, however, the tackiness of the liquid ink may cause a portion of the ink to remain on the drum after the image is transferred onto the media sheet which may later degrade other images formed on the drum.

To address the accumulation of ink on a imaging drum, solid ink imaging systems may be provided with a drum maintenance unit (DMU). In solid ink imaging systems, the DMU is configured to 1) lubricate the image receiving surface of the drum with a very thin, uniform layer of release agent (e.g., silicone oil) before each print cycle, and 2) remove and store any excess oil, ink and debris from the surface of the drum after each print cycle. Previously known DMU's typically included a reservoir for holding a suitable release agent, an applicator that receives oil from the reservoir and applies the oil to the surface of the drum, and a metering blade for metering the oil applied to the surface of the drum by the applicator.

DMU's have an expected lifetime, or useful life, that corresponds to the amount of oil stored in the reservoir, often correlated to a number of prints that the DMU is capable of providing adequate oil for image transfer. For example, some DMU's may have a useful life between approximately 300,000 and 500,000 prints depending on factors such as oil usage and the amount of oil in the reservoir. One factor that affects the useful life of a DMU is excess oil being delivered to the drum over time.

Excess oil being delivered to drum, in turn, may be caused by metering blade wear. Metering blade wear is, in part, determined by the arrangement of the metering blade with respect to the drum, also referred to as the mode of the metering blade. In previously known systems, the metering blade was arranged in either a "wiper mode" or a "doctor mode." In wiper mode, the metering blade is arranged with the blade tip oriented to wipe or squeegee the oil on the surface of the drum, and, in doctor mode, the metering blade is arranged with the blade tip oriented against the direction of rotation of the drum, similar to a chisel. Blade wear is typically faster when in the wiper mode due to the pressure that is exerted on the blade to keep the blade tip adjacent the drum surface for metering the oil. Conversely, blade wear is less when the metering blade is arranged in the doctor mode.

A disadvantage of the use of the metering blade in doctor mode is the formation of an oil bar on the drum surface. In previously known metering blade configurations, the metering blade had a square tip. In doctor mode, the square-end of the blade acts as a dam and traps a large bead of oil on the image drum surface. During operation, the metering blade is typically moved into and out of engagement with the drum. When the blade is disengaged from the drum, the bead of oil splits leaving an oil bar on the surface of the drum. Depending on the size of the oil bar, an amount of oil may be left on the drum after the metering blade is disengaged from the drum that unnecessarily increases the amount of oil that is used per print, thus decreasing the useful life of the DMU.

In addition to decreasing the useful life of a DMU, excess oil on the drum surface, due to metering blade wear or oil bar size, may result in an image quality defect known as "duplex dropout." In sustained duplex printing, oil applied by the DMU to the drum is transferred to the "front" side of the paper while printing the front side of the paper and then from the "front" side of the paper to the transfix roll during the printing of the back side (i.e., duplex side) of the paper. During subsequent printing, oil that gets on the transfix roll may be transferred to the "back" side of a sheet of paper when printing on the front side. When excess oil is delivered to the drum during the front side print step, the thickness or amount of oil on the front side of the paper may interfere with the transfer of the image to the back side of the paper resulting in some or all of the image not transferring to the back side of the sheet, also referred to as "duplex dropout."

SUMMARY

In one embodiment, a drum maintenance system has been developed that includes a second metering blade and a positioning system that selectively activates the second metering blade to meter release agent for the front side printing of duplex print jobs in order to reduce oil on the front side of the print which contributes to the image quality defect known as "duplex dropout." In particular, in one embodiment, a drum maintenance system for use in an imaging device includes a reservoir having a supply of release agent, and an applicator configured to receive release agent from the reservoir and to apply the release agent to an intermediate transfer surface of an imaging device. A first metering blade is positioned in wiper mode at a first position adjacent the intermediate transfer surface and configured to meter the release agent on the intermediate transfer surface applied by the applicator. A second metering blade is positioned in wiper mode at a second position adjacent the intermediate transfer surface. The system includes a second metering blade positioning system operably coupled to the second metering blade and configured to move the second metering blade into engagement with the intermediate transfer surface to further meter release agent applied to the intermediate transfer surface by the applicator when printing a first side of a duplex print job and out of engagement with the intermediate transfer surface when printing simplex print jobs and when printing a second side of a duplex print job.

In another embodiment, a method of operating a drum maintenance system of a phase change ink imaging device comprises receiving a print job, and applying a release agent to the intermediate transfer surface the phase change ink imaging device. The release agent on the intermediate transfer surface is then metered with a first metering blade. A determination is made as to whether the print job is a duplex print job. A second metering blade is moved into engagement with the intermediate transfer surface to further meter the release agent on the intermediate transfer surface for at least one side of the print job in response to the print job being a duplex print job. The second metering blade is left out of engagement with the intermediate transfer surface in response to the print job being a simplex print job.

In yet another embodiment, a phase change ink imaging device includes an intermediate transfer surface configured to move in a process direction, and at least one printhead configured to emit melted phase change ink onto the intermediate transfer surface. The imaging device includes a drum maintenance unit having a reservoir including a supply of release agent, and an applicator configured to receive release agent from the reservoir and to apply the release agent to the intermediate transfer surface. A first metering blade is positioned in wiper mode at a first position adjacent the intermediate transfer surface and configured to meter the release agent on the intermediate transfer surface applied by the applicator. A second metering blade is positioned in wiper mode at a second position adjacent the intermediate transfer surface. The drum maintenance system includes a second metering blade positioning system operably coupled to the second metering blade and configured to move the second metering blade into engagement with the intermediate transfer surface to further meter release agent applied to the intermediate transfer surface by the applicator when printing a first side of a duplex print job and out of engagement with the intermediate transfer surface when printing simplex print jobs and when printing a second side of a duplex print job.

BRIEF DESCRIPTION OF THE DRAWINGS

The foregoing aspects and other features of the present disclosure are explained in the following description, taken in connection with the accompanying drawings, wherein.

DETAILED DESCRIPTION

Figure 1:
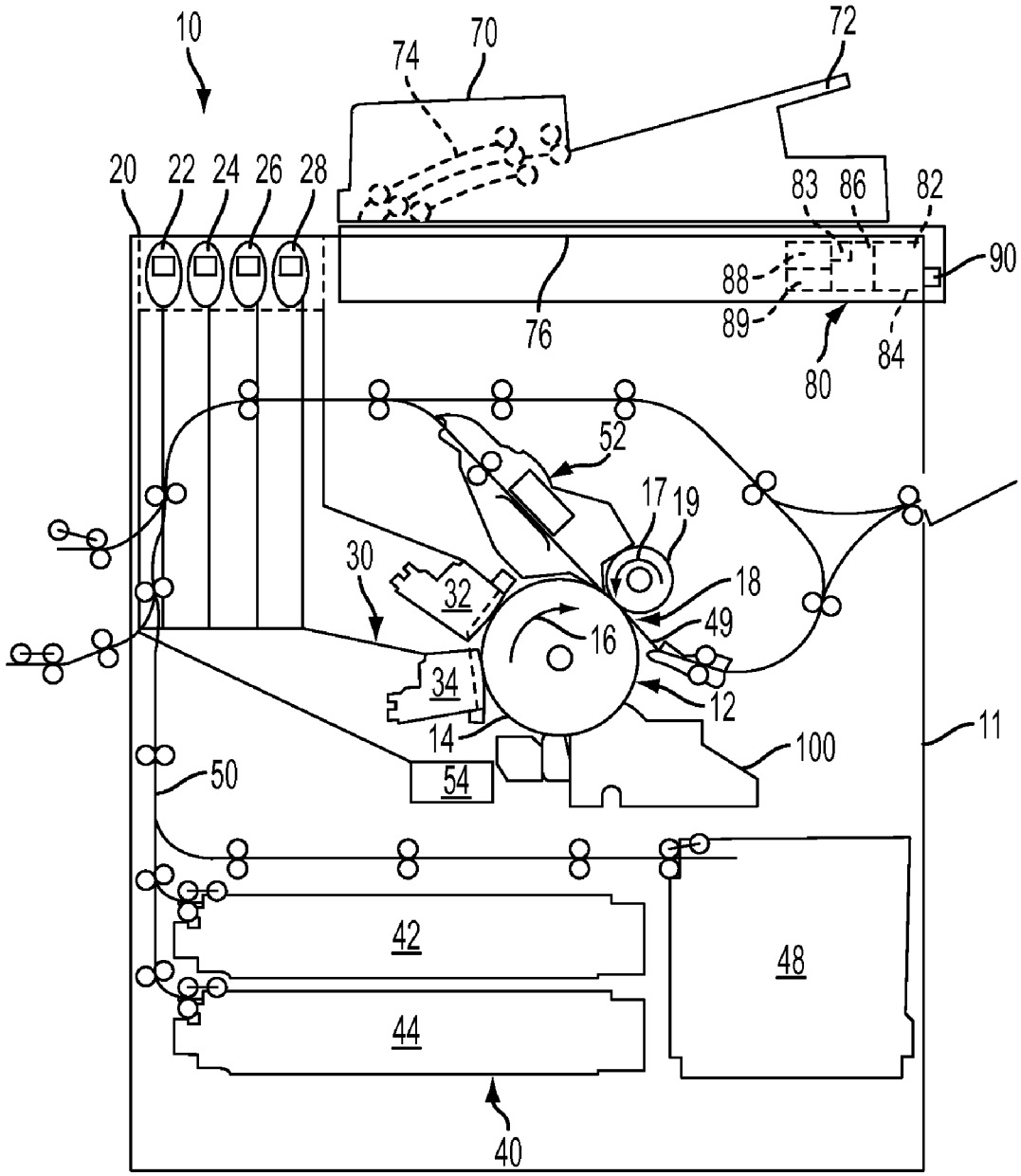
FIG. 1 is a schematic diagram of an embodiment of an imaging device.

For a general understanding of the present embodiments, reference is made to the drawings. In the drawings, like reference numerals have been used throughout to designate like elements.

As used herein, the terms "printer" or "imaging device" generally refer to a device for applying an image to print media and may encompass any apparatus, such as a digital copier, bookmaking machine, facsimile machine, multi-function machine, etc. which performs a print outputting function for any purpose. "Print media" can be a usually flimsy physical sheet of paper, plastic, or other suitable physical print media substrate for images. A "print job" or "document" is normally a set of related sheets, usually one or more collated copy sets copied from a set of original print job sheets or electronic document page images, from a particular user, or otherwise related. As used herein, the term "consumable" refers to anything that is used or consumed by an imaging device during operations, such as print media, marking material, cleaning fluid, and the like. An image generally may include information in electronic form which is to be rendered on the print media by the image forming device and may include text, graphics, pictures, and the like. The operation of applying images to print media, for example, graphics, text, photographs, etc., is generally referred to herein as printing or marking.

Referring now to FIG. 1, an embodiment of an imaging device 10 of the present disclosure, is depicted. As illustrated, the device 10 includes a frame 11 to which are mounted directly or indirectly all its operating subsystems and components, as described below. In the embodiment of FIG. 1, imaging device 10 is an indirect marking device that includes an intermediate imaging member 12 that is shown in the form of a drum, but can equally be in the form of a supported endless belt. The imaging member 12 has an image receiving surface 14 that is movable in the direction 16, and on which phase change ink images are formed. A transfix roller 19 rotatable in the direction 17 is loaded against the surface 14 of drum 12 to form a transfix nip 18, within which ink images formed on the surface 14 are transfixed onto a media sheet 49. In alternative embodiments, the imaging device may be a direct marking device in which the ink images are formed directly onto a receiving substrate such as a media sheet or a continuous web of media.

The imaging device 10 also includes an ink delivery subsystem 20 that has at least one source 22 of one color of ink. Since the imaging device 10 is a multicolor image producing machine, the ink delivery system 20 includes four (4) sources 22, 24, 26, 28, representing four (4) different colors CYMK (cyan, yellow, magenta, black) of ink. The ink delivery system is configured to supply ink in liquid form to a printhead system 30 including at least one printhead assembly 32. Since the imaging device 10 is a high-speed, or high throughput, multicolor device, the printhead system 30 includes multicolor ink printhead assemblies and a plural number (e.g. four (4)) of separate printhead assemblies, two of which are shown 32, 34 in FIG. 1).

In one embodiment, the ink utilized in the imaging device 10 is a "phase-change ink," by which is meant that the ink is substantially solid at room temperature and substantially liquid when heated to a phase change ink melting temperature for jetting onto an imaging receiving surface. Accordingly, the ink delivery system includes a phase change ink melting and control apparatus (not shown) for melting or phase changing the solid form of the phase change ink into a liquid form. The phase change ink melting temperature may be any temperature that is capable of melting solid phase change ink into liquid or molten form. In one embodiment, the phase change ink melting temperate is approximately 100° C. to 140° C. In alternative embodiments, however, any suitable marking material or ink may be used including, for example, aqueous ink, oil-based ink, UV curable ink, or the like.

As further shown, the imaging device 10 includes a media supply and handling system 40. The media supply and handling system 40, for example, may include sheet or substrate supply sources 42, 44, 48, of which supply source 48, for example, is a high capacity paper supply or feeder for storing and supplying image receiving substrates in the form of cut sheets 49, for example. The substrate supply and handling system 40 also includes a substrate or sheet heater or preheater assembly 52. The imaging device 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 84, and a display or user interface (UI) 86. The ESS or controller 80 for example includes a sensor input and control system 88 as well as a pixel placement and control system 89. In addition the CPU 82 reads, captures, prepares and manages the image data flow between image input sources such as the scanning system 76, or an online or a work station connection 90, and the printhead assemblies 32, 34. As such, the ESS or controller 80 is the main multi-tasking processor for operating and controlling all of the other machine subsystems and functions, including the printhead cleaning apparatus and method discussed below.

In operation, image data for an image to be produced are sent to the controller 80 from either the scanning system 76 or via the online or work station connection 90 for processing and output to the printhead assemblies 32, 34. Additionally, the controller determines and/or accepts related subsystem and component controls, for example, from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by any one of the sources 42, 44, 48 along supply path 50 in timed registration with image formation on the surface 14. Finally, the image is transferred from the surface 14 and fixedly fused to the copy sheet within the transfix nip 18.

To facilitate transfer of an ink image from the drum to a recording medium, a drum maintenance system 100, also referred to as a drum maintenance unit (DMU), is provided to apply release agent to the surface 14 of the print drum 12 before ink is ejected onto the print drum. The release agent provides a thin layer on which an image is formed so the image does not adhere to the print drum. The release agent is typically silicone oil although any suitable release agent may be used.

Figure 2:
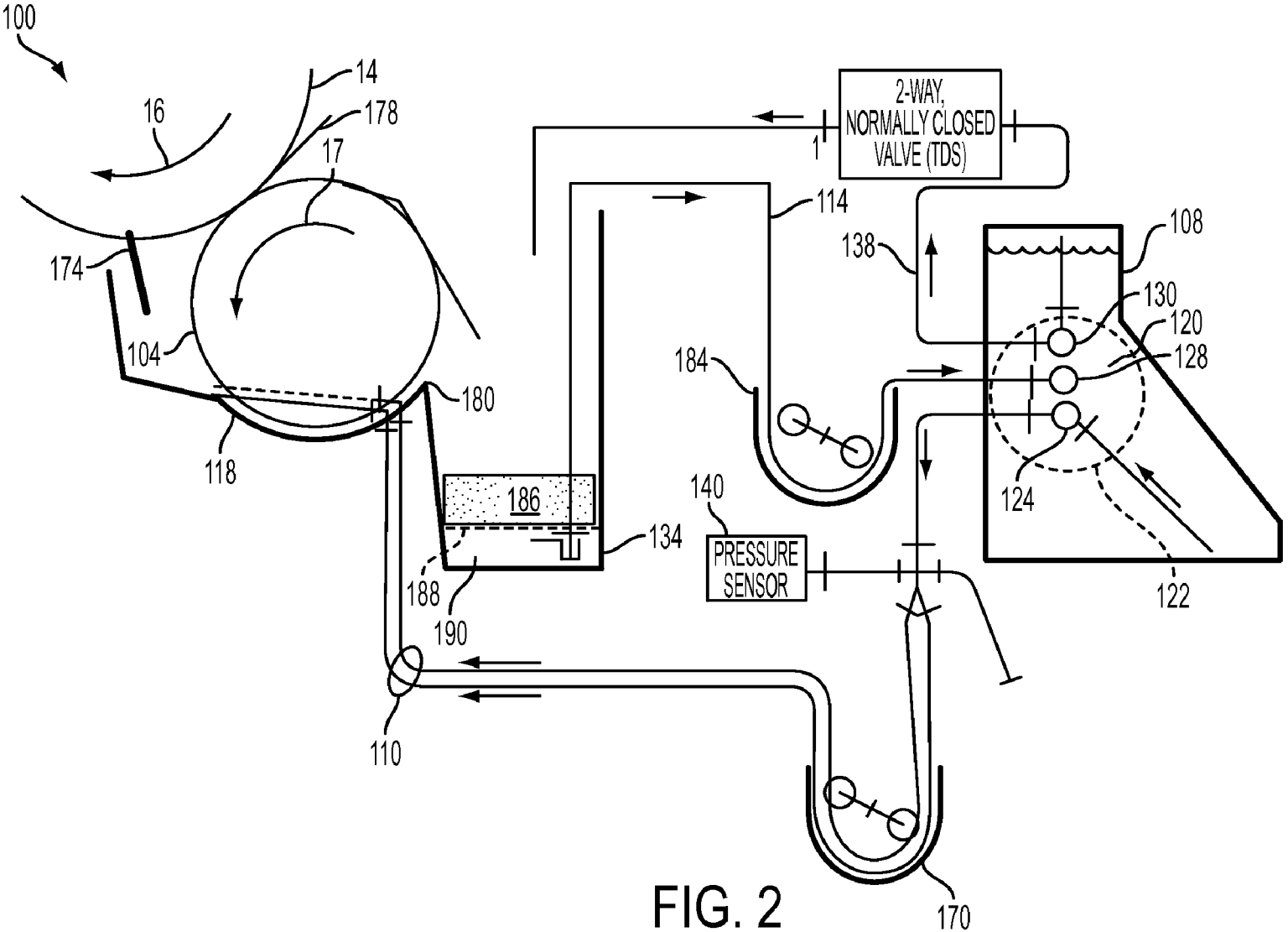
FIG. 2 is a schematic diagram of a drum maintenance unit for use in the imaging device of FIG. 1.

Referring now to FIG. 2, a schematic diagram of an embodiment of a DMU is illustrated. As depicted, the DMU 100 includes a release agent applicator 104 in the form of a roller which is configured to apply a release agent, such as silicon oil to the imaging surface 14 as it rotates. In embodiments, the roller 104 is formed from an absorbent material, such as extruded polyurethane foam. The polyurethane foam has an oil retention capacity and a capillary height that enables the roller to retain fluid even when fully saturated with release agent fluid. To facilitate saturation of the roller with the release agent, the roller 104 is positioned over a reclaim receptacle 118 in the form of a tub or trough, referred to herein as a reclaim trough. In one embodiment, the reclaim trough 118 has a bottom surface that follows the cylindrical profile of the lower portion of the roller. The roller 104 is positioned with respect to the reclaim trough 118 so that it is partially submerged in the release agent received therein.

The reclaim trough 118 is configured to receive release agent from a release agent reservoir 108. In the embodiment of FIG. 2, the reservoir 108 comprises a plastic, blow-molded bottle or tube having an opening 122 at one end that enables a predetermined amount of release agent to be loaded into the reservoir. Sealed over the opening 122 of the reservoir is an end cap 120. The end cap 120 may be sealed to the opening in any suitable manner such as by spin welding, gluing, or the like. The end cap 120 has three fluidic pass-through openings 124, 128, 130. Three tubes are connected to the openings on the outside of the end cap using barbed fittings, for example, including a delivery tube 110 that fluidly connects the reservoir 108 to the reclaim area 118, a sump tube 114 (recirculation tube) that fluidly connects the reservoir 108 to the sump 134 (explained below), and a vent tube 138 fluidly connects the interior of the reservoir 108 to atmosphere to relieve any positive or negative pressure developed in the reservoir. The vent tube includes a solenoid valve 144 that is normally closed to prevent any oil leaks during shipping and customer handling. The solenoid valve 144 is opened as oil is being pumped into and out of the oil reservoir to allow the reservoir to vent to atmospheric pressure. In the exemplary embodiment of FIG. 3, the delivery tube 110 begins as a single tube extending from the reservoir 108 and is divided into two tubes prior to reaching the reclaim trough 118. These two tubes supply oil to opposite ends of the trough 118 so that an equal amount of oil is delivered to both ends of the roller which prevents uneven oil saturation over the length of the roller.

Referring again to FIG. 2, a release agent delivery system 170 is configured to pump release agent from the reservoir through the tubes 110 to the reclaim area 118 at a predetermined rate of flow $F_{RA}$ that is intended to keep the applicator 104 fully saturated during operation. In one embodiment, the delivery system 170 includes a peristaltic delivery pump. The peristaltic delivery pump 170 includes a pair of rotors through which the two tubes 110 that connect the reservoir to each end of the applicator are extended. The rotation of the rotors under the driving force of a motor (not shown) squeezes the delivery conduits in a delivery direction toward the reclaim trough. As the release agent is pushed through the tubes 110 in the delivery direction, release agent is being pulled into the tubes from the reservoir. Driving two tubes driven through one peristaltic pump insures equal oil delivery to both end of the applicator roller regardless of the effects of gravity on a tilted system.

In operation, as the imaging drum 12 rotates in the direction 16, the roller 104 is driven to rotate in the direction 17 by frictional contact with the transfer drum surface 14 and applies the release agent to the drum surface 14. As the roller 104 rotates, the point of contact on the roller 104 is continuously moving such that a fresh portion of the roller 104 is continuously contacting the drum surface 14 to apply the release agent. A metering blade 174 is positioned to meter release agent applied to the drum surface 14 by the roller 104. The oil impregnated roller 104 applies enough oil to the drum surface to maintain a constant puddle or "oil dam" in front of the metering blade 174 to insure that there is always a sufficient amount of oil available to be metered. The metering blade 174 may be formed of an elastomeric material such as urethane supported on an elongated metal support bracket (not shown). The metering blade 174 helps insure that a uniform thickness of the release agent is present across the width of the drum surface 14. In addition, the metering blade 174 is positioned above the reclaim trough 118 so that excess oil metered from the drum surface 14 by blade 174 is diverted down the metering blade 174 back to the reclaim trough 118.

The DMU 100 may also include a cleaning blade 178 that is positioned with respect to the drum surface 14 to scrape oil and debris, such as paper fibers, untransfixed ink pixels and the like, from the surface 14 of the drum prior to the drum being contacted by the roller 104 and metering blade 174. In particular, after an image is fixed onto a print media, the portion of the drum upon which the image was formed is contacted by the cleaning blade 178. The cleaning blade 178 may be formed of an elastomeric material and is positioned above the reclaim trough 118 so that that oil and debris scraped off of the drum surface by the cleaning blade is directed to the reclaim trough as well.

The reclaim trough 118 is capable of holding a limited amount of release agent. The volume of oil held in the reclaim trough is set to be the smallest amount that keeps the roller fully saturated. The reclaim trough volume is minimized to limit the potential for oil spills when the DMU is tilted. The volume of the reclaim trough is set by the height of the overflow wall that allows oil to flow into the sump area. Once the reclaim trough 118 has been filled with release agent received from the reservoir as well as release agent and debris diverted into the reclaim trough by the metering blade, excess release agent flows over the edge 180 of the reclaim trough 118 and is captured in sump 134 prior to recirculation to the reservoir 108. Sump 134 is fluidly coupled to the reservoir 108 by at least one flexible conduit or tube 114. A sump pump 184 is configured to pump release agent from the sump 134 through the sump tube 114 to the reservoir 108 at a predetermined rate of flow $F_{AR}$. In one embodiment, the sump pump comprises a peristaltic pump although any suitable pumping system or method may be used that enables the release agent to be pumped to the reservoir at a desired flow rate. Referring again to FIG. 2, sump 134 may include a filter that ink, oil, and debris must pass through prior to being recirculated into the oil reservoir. The purpose of the filter is to remove any particles that are large enough to cause a clog in the fluid path, e.g. sump tube.

The DMU 100 described above may comprise a customer replaceable unit (CRU). As used herein, a CRU is a self-contained, modular unit which includes all or most of the components necessary to perform a specific task within the imaging device enclosed in a module housing that enables the CRU to be inserted and removed from the imaging device as a functional self-contained unit. The DMU may include a housing (now shown) in which the components of the DMU, such as the applicator 104 and oil reservoir 108 (as well as other components described above in connection with the schematic diagram of the DMU depicted in FIG. 4) are enclosed. The DMU housing, including all of the internal components, is configured for insertion into and removal from the imaging device 10 as a self-contained unit.

As a CRU, the DMU 100 has an expected lifetime, or useful life, that corresponds to the amount of oil loaded in the DMU reservoir 108. In the exemplary embodiment, the useful life may be between approximately 300,000 and 500,000 depending on factors such as oil usage and the amount of oil in the reservoir. When the DMU has reached the end of its useful life, i.e. is out of oil, the DMU may be removed from its location or slot in the imaging device and replaced with a new DMU. One factor that impacts the useful or expected life of a DMU is oil usage efficiency. As used herein, the term "oil usage efficiency", and the like, refers to the amount of oil used per print generated by the imaging device.

One factor that affects oil usage efficiency for the DMU is metering blade wear. For example, repeated contact between the metering blade and the drum surface may result in damage or degradation of the metering blade over time. A damaged or worn metering blade may not meter the oil on the surface of the drum as efficiently as an undamaged or unworn metering blade resulting in an increase in the amount of oil used per print, i.e., a decrease in oil usage efficiency and a corresponding decrease in the useful life of a DMU.

Figure 3:
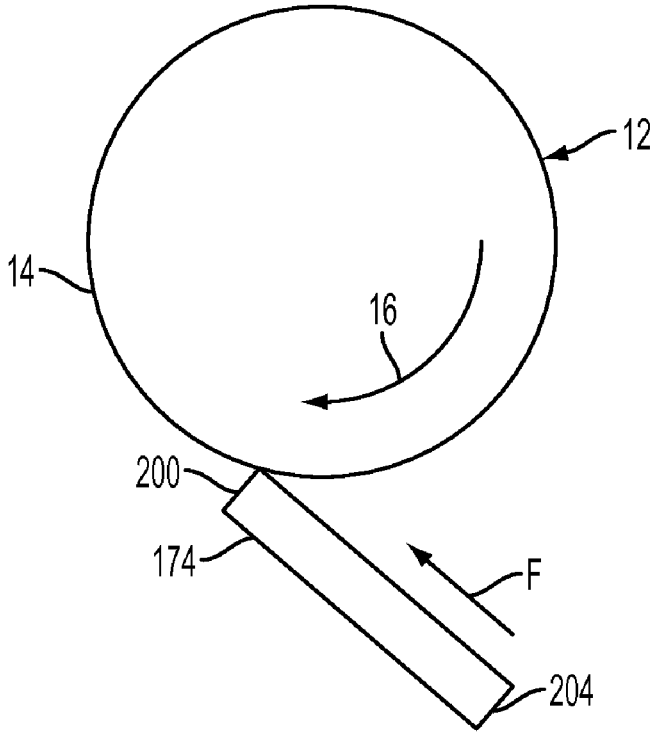
FIG. 3 is a schematic diagram showing a metering blade in wiper mode with respect to the transfer drum of the imaging device of FIG. 1.
Figure 4:
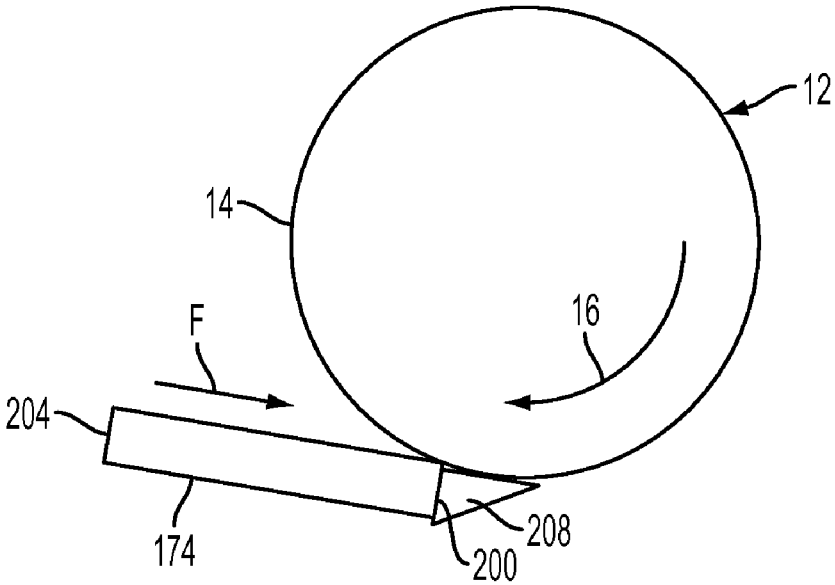
FIG. 4 is a schematic diagram showing a metering blade in doctor mode with respect to the transfer drum of the imaging device of FIG. 1.

Metering blade wear is, in part, determined by the arrangement of the metering blade with respect to the drum, also referred to as the mode of the metering blade. In previously known systems, the metering blade was arranged in either a "wiper mode" or a "doctor mode." As used herein, the wiper mode refers to an arrangement of the metering blade in which the tip of the blade extends in a direction that follows the direction of rotation of the drum so that the tip of the blade is drawn across the drum surface with the rotation of the drum. FIG. 3 shows a metering blade 174 arranged in a wiper mode adjacent the transfer drum 12. As depicted, the metering blade 174 includes a first end 200, also referred to as the blade tip, that is arranged proximate the surface 14 of the drum 12, and a second end 204 arranged distally from the surface 14 of the drum. When in the wiper mode, the direction F from the second end 204 to the first end 200 is oriented substantially in the direction of rotation 16 of the drum. The doctor mode refers to an arrangement of the metering blade in which the tip of the blade extends in a direction against the direction of rotation of the drum so that the tip of the blade scrapes the surface of the drum in a manner similar to a chisel. For example, FIG. 4 shows a metering blade 174 arranged in a doctor mode adjacent the transfer drum 12. As depicted, when in the doctor mode, the direction F from the second end 204 to the first end 200 is oriented substantially opposite the direction of rotation 16 of the drum.

Figure 5:
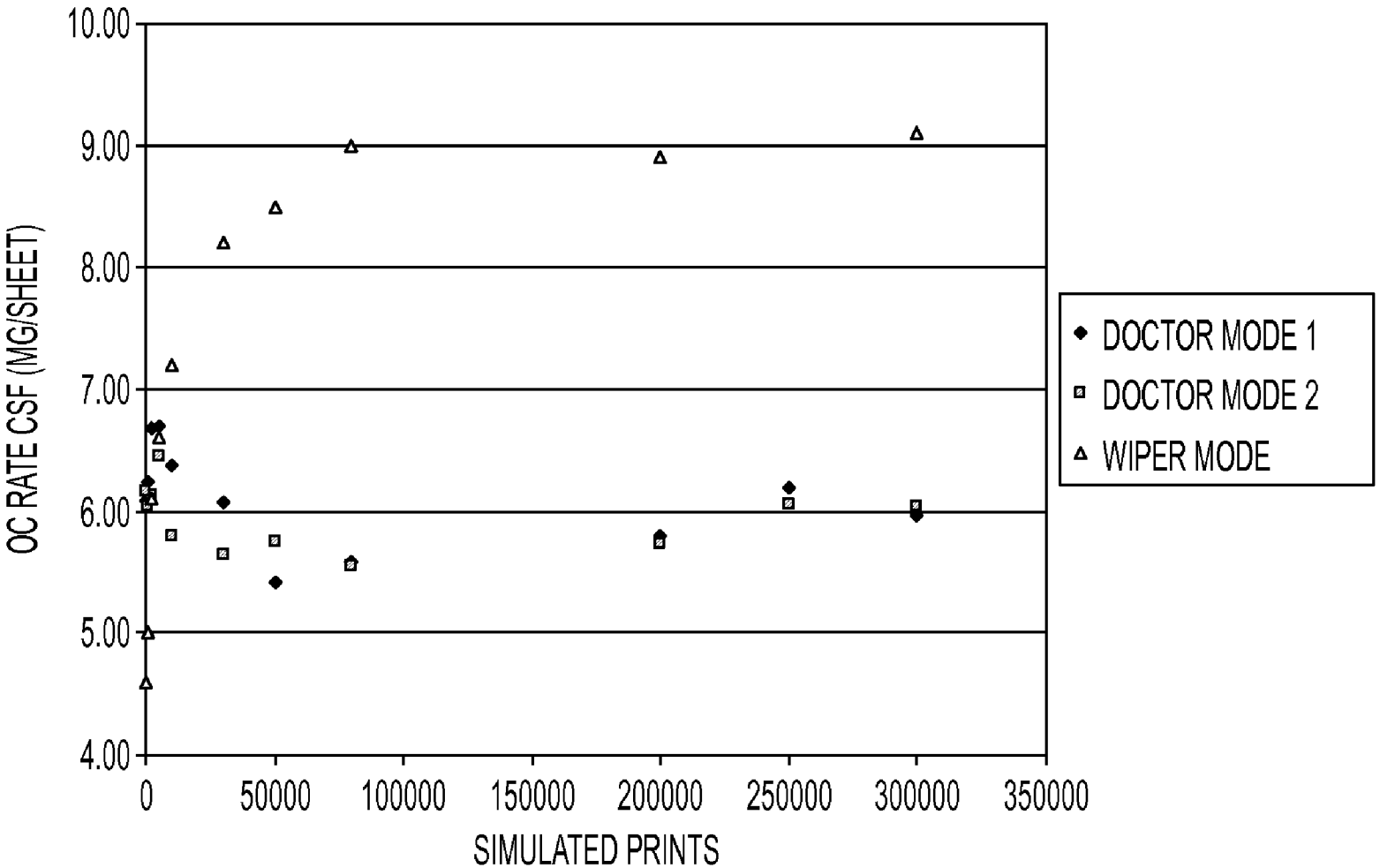
FIG. 5 is a graph of the oil consumption rate vs. number of prints for metering blades in wiper mode and doctor mode.

Blade wear is typically faster when in the doctor mode due to the pressure that is exerted on the blade to keep the blade tip adjacent the drum surface for metering the oil. Conversely, blade wear is less when the metering blade is arranged in the wiper mode. FIG. 5 shows a graph of the amount of oil used per sheet (in milligrams) with the metering blade in wiper mode and doctor mode over a life of 300,000 prints. As seen in the graph of FIG. 5, oil usage increases with the number of prints for the wiper mode blade from approximately 3-4 mg/sheet to approximately 8-9 mg/sheet due to wear of the metering blade. The oil usage for the doctor mode blade stays substantially consistent at approximately 6 mg/sheet over the 300,000 prints.

A disadvantage of the use of the metering blade in doctor mode is the formation of an oil bar on the drum surface. In previously known metering blade configurations, the metering blade had a square tip as depicted in FIGS. 3 and 4. In doctor mode, the square-end 200 of the blade 174 acts as a dam and traps a large bead of oil 208 on the image drum surface 14. During operation, the metering blade 174 is moved into and out of engagement with the drum either by moving the metering blade alone or by moving the entire DMU. When the blade is disengaged from the drum, the oil dam splits leaving an oil bar on the surface of the drum. The size of the oil bar left on the drum corresponds substantially to the width of the square tip of the doctor mode blade. The thicker the doctor mode blade, the larger the oil bar. Depending on the size of the oil bar, a significant amount of oil may be left on the drum after the metering blade is disengaged from the drum. The oil bar left on the drum increases the amount of oil that is used per print.

As an alternative to using a square end metering blade in wiper mode or doctor mode, one aspect of the present disclosure is directed to a metering blade configuration for use with the DMU that enables the metering blade to be positioned in the doctor mode for reducing wear while keeping the size of the oil bar within acceptable limits. In particular, in one embodiment, a metering blade in doctor mode is provided that includes a tip having a beveled edge to reduce the width of the oil bar by reducing the volume of oil trapped at the tip of the blade.

Figure 6:
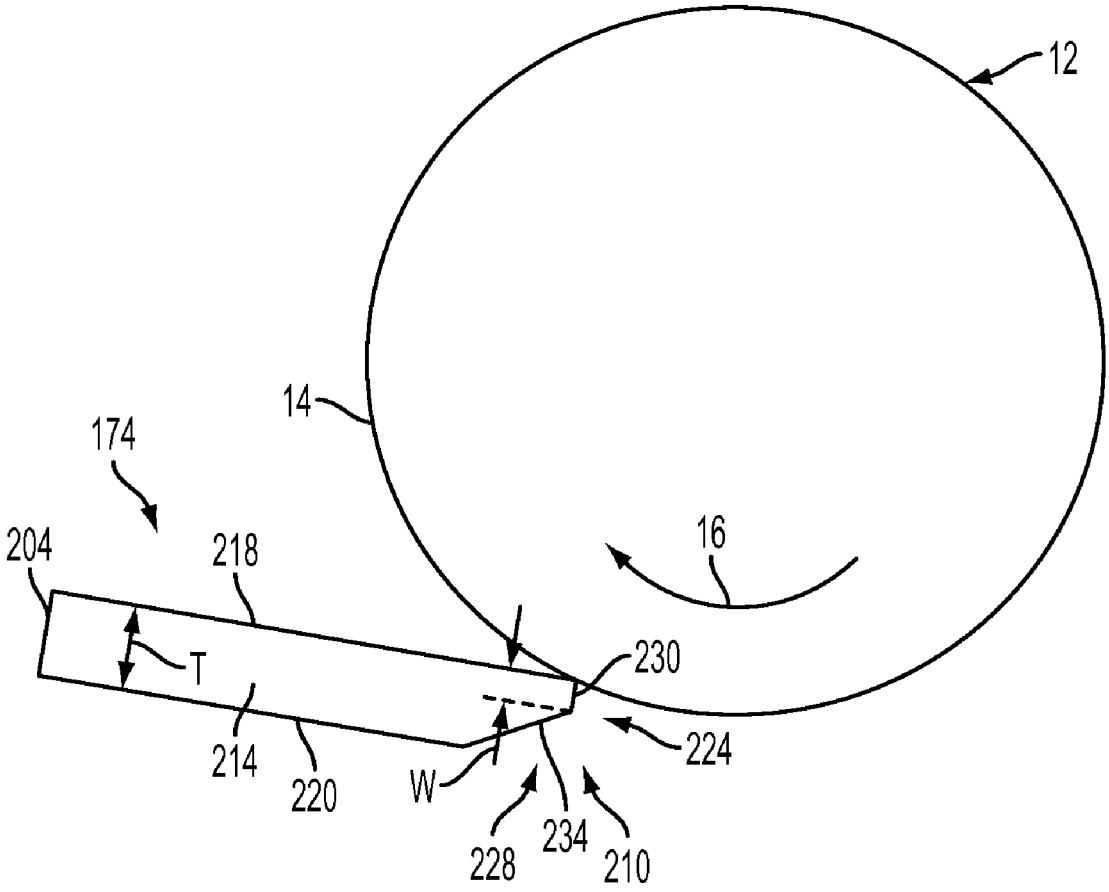
FIG. 6 is a schematic diagram showing a metering blade in doctor mode having a beveled edge tip.

FIG. 6 shows an embodiment of a metering blade 174 having a beveled edged tip for reducing oil bar size. As depicted in FIG. 6, the metering blade includes a first end 210, or tip, that is arranged proximate the surface 14 of the drum 12, and a second end 204 arranged distally from the surface 14 of the drum 12. The metering blade body 214 extends between the first 210 and second ends 204 and has an inboard side 218 facing substantially toward the drum 12 and an outboard side 220 facing away from the drum 12. In one embodiment, the metering blade body 214 is formed of urethane and has a thickness T of approximately 2 mm although other suitable materials and thicknesses may be used. In one embodiment, the metering blade has a durometer of approximately 70-74. The metering blade of FIG. 6 is arranged in doctor mode so the direction F from the second end to the first end is oriented substantially opposite the direction of rotation of the drum.

In the embodiment of FIG. 6, the tip 210 of the metering blade includes a square portion 224 positioned adjacent the drum surface 14 and a beveled portion 228 positioned distally from the drum surface 14. The square portion 224 of the blade tip 210 is used to meter the oil onto the surface 14 of the drum 12 and includes a first surface 230 extending from the inboard side 218 of the metering blade body a predetermined distance W toward the outboard side 220. The first surface 230 is arranged substantially perpendicular to the direction F of the metering blade body. The first surface 230 and the inboard side 218 of the metering blade body meet at a substantially 90 degree angle although deviations, i.e., +−10 degrees, from the 90 degree angle may be used. The predetermined distance W of the first surface 230 controls the width of the square portion 224 of the tip of the metering blade and is less than the width T of the metering blade body. In one embodiment, the predetermined distance W is approximately 1 mm although other distances (less than the width of the blade body) may be used.

A second surface 234 extends from the first surface 230 toward the outboard side 220 of the metering blade that is angled at an angle A relative to the first surface 230 toward the second end 204 of the metering blade to form the beveled portion 228 of the tip. The angled second surface 234 of the blade tip reduces the width of the blade tip and enables excess oil as well as debris that is captured in the oil dam formed by the first surface 230 of the blade tip to flow over the first surface 230 and be directed away from the drum. In one embodiment, the angle A is approximately 60 degrees although any suitable angle may be used. In addition, although the beveled portion 228 of the metering blade tip is shown as being substantially flat, other surface configurations may be used that enable excess oil and debris from the oil dam in front of the first surface 230 of the blade tip to be guided away from the drum. For example, the second surface 234 may be convex or concave shaped.

Another aspect of the present disclosure is directed toward reducing metering blade wear that involves translating the metering blade axially, i.e., in the cross-process direction, across the drum surface. Translating the metering blade axially on the drum surface distributes wear caused by the roughest sections of the drum by not always having the same portion of the blade exposed to the same portion of the image drum during operations. The translation of the metering blade causes the blade tip stresses to be spread out over a large area, therefore decreasing blade wear and, consequently, oil consumption.

Figure 7:
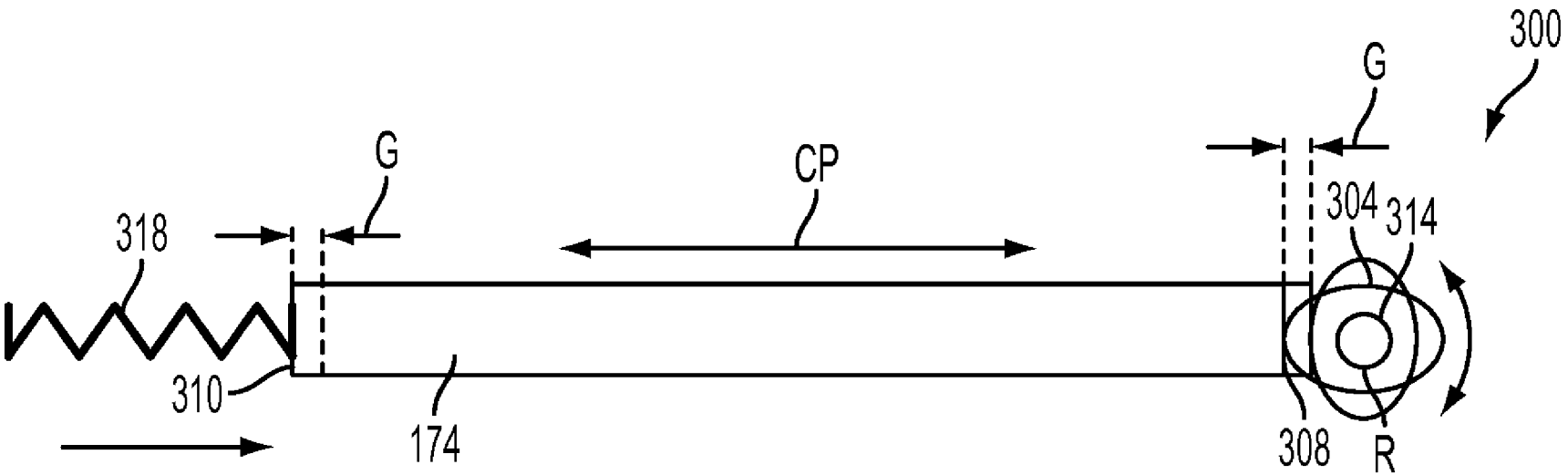
FIG. 7 is a schematic diagram of a metering blade translation system for use with the DMU of FIG. 2.

FIG. 7 depicts an embodiment of a system 300 for translating a metering blade 174 in a cross-process direction CP across the surface of the drum (not shown in FIG. 7) that may be used with a DMU such as the DMU depicted in FIG. 2. The metering blade 174 may be arranged in the wiper mode or the doctor mode and includes a longitudinal axis that extends substantially in the cross-process direction relative to the drum. As depicted, the system 300 includes a driver 304 operably coupled to the metering blade 174 that is configured to translate the metering blade axially back and forth a predetermined distance G between a first position and a second position along an axis substantially parallel to the longitudinal axis of the metering blade. As used herein, the term axially in relation to metering blade movement refers to a direction or directions that are substantially parallel to the longitudinal axis of the metering blade body. In one embodiment, the driver is configured to axially move the metering blade separate from the DMU. Alternatively, the driver may be operably coupled to the DMU to axially move the DMU, including the metering blade, as a unit.

In one embodiment, the predetermined distance G of translation along the CP axis may be approximately 1-10 mm although any suitable translation distance may be used. In one particular embodiment, the translation distance G is approximately 2 mm. The translation of the metering blade across the surface of the drum in a first direction and then back across the surface of the drum in the opposite direction is referred to herein as a translation cycle. In one embodiment, metering blade translation cycles may be performed at a rate of approximately 1-10 cycles per minute when the metering blade 174 is engaged against the drum surface although translation cycles may be performed at any suitable rate. In one particular embodiment, translation cycles may be performed at approximately 7 cycles per minute. The cycle distance and rate can be adjusted to optimize the DMU blade performance for oil rate and blade life.

In one embodiment, the driver 304 comprises a cam operably coupled to a first lateral end 308 of the metering blade 174. Cam 304 may be mounted on a drive shaft 314 which is in turn operably coupled to a motor (not shown). The motor rotates the drive shaft 314 thereby rotating the cam about an axis R. As the cam rotates about axis R, the cam surface causes the metering blade 174 to translate axially back and forth across the drum surface. A biasing apparatus 318, such as spring, is attached at the other end 310 of the metering blade 174. The biasing spring 318 biases the first end 308 of the metering blade into contact with the cam 304. Any suitable method or device, however, may be used to translate the metering blade axially across the drum surface at the predetermined distance and rate.

Figure 8:
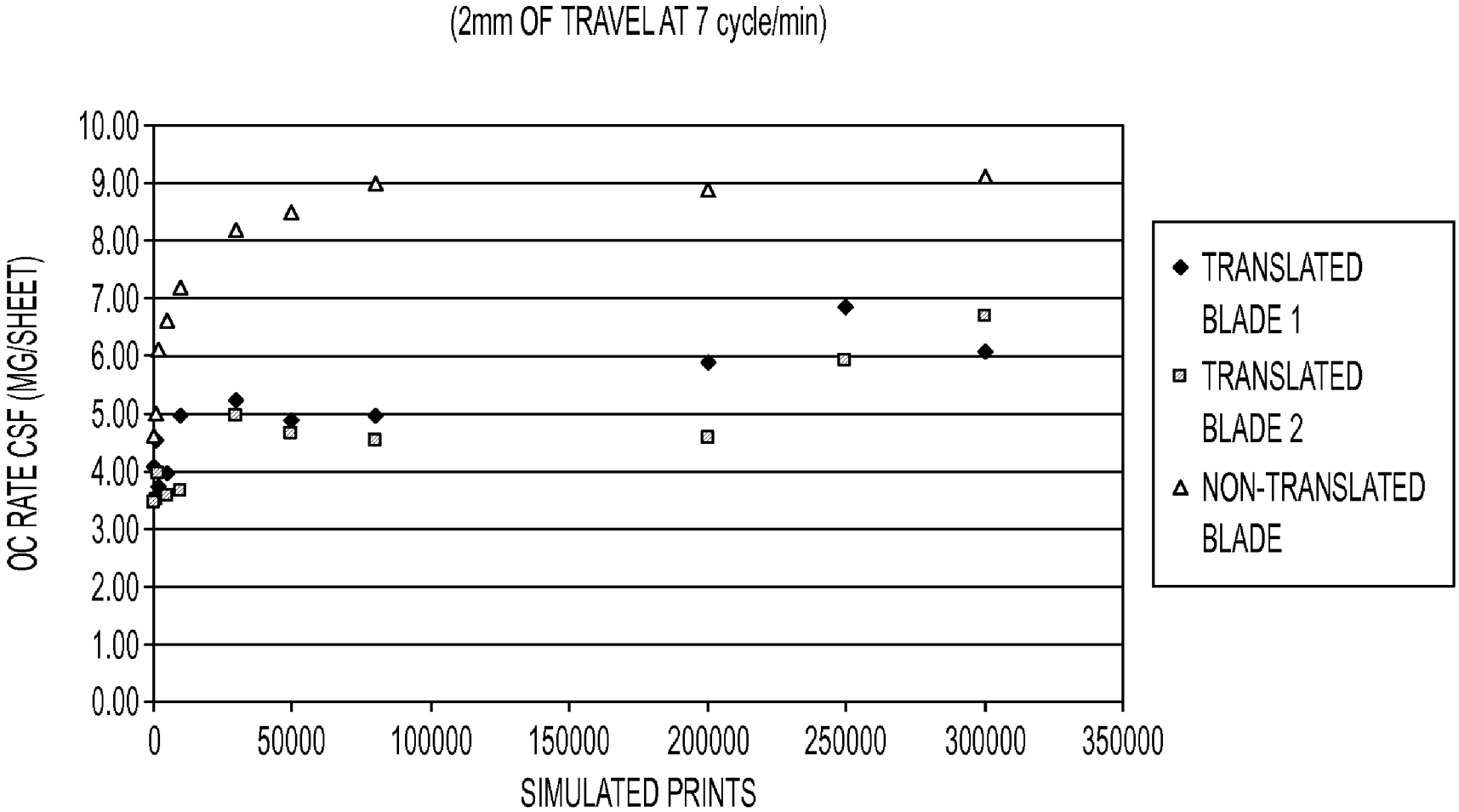
FIG. 8 is a graph of the oil consumption rate vs. number of prints for translated metering blades and stationary metering blades.

FIG. 8 is a plot of the oil consumption rate over a number of prints for a DMU with metering blade translation and for a DMU without metering blade translation. As depicted in FIG. 8, the oil usage increased with the number of prints for the DMU using the stationary (i.e., non-translating) metering blade from approximately 3-4 mg/sheet to approximately 8-9 mg/sheet due to, for example, wear of the metering blade. The oil usage for the DMUs with the translating metering blade increased with the number of prints from approximately 3-4 mg/sheet to approximately 6 mg/sheet. Thus, the translation of the metering blade may result in long-term oil carry out of 6 mg of oil per sheet of paper relative to 9 mg/sheet for non-translating metering blades.

Figure 9:
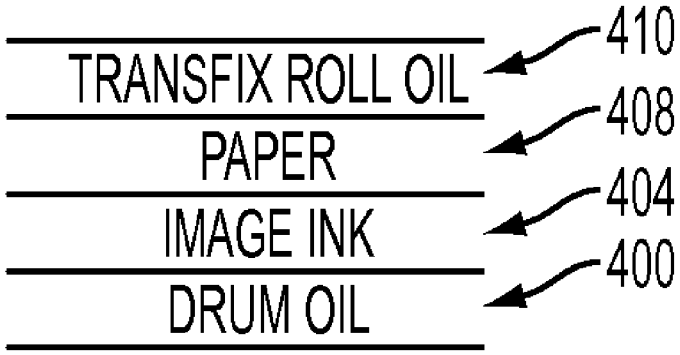
FIG. 9 is a layer diagram of a printed sheet after the front side print step.
Figure 10:
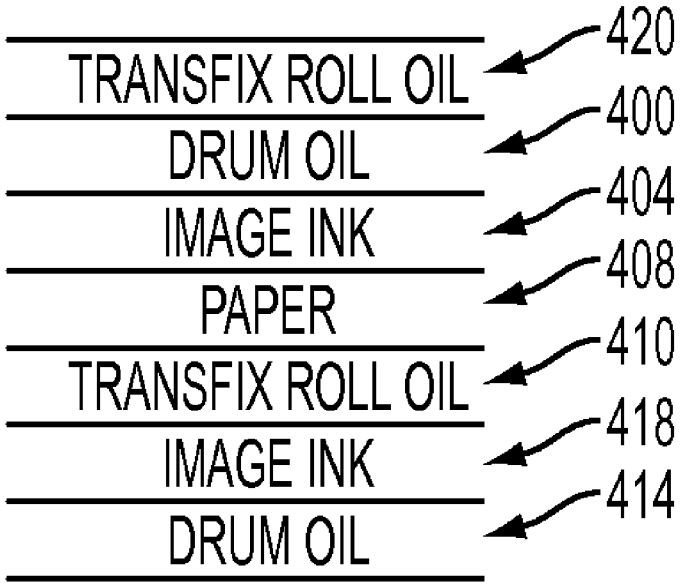
FIG. 10 is a layer diagram of the printed sheet of FIG. 9 after the back side print step.

In addition to decreasing the useful life of a DMU, excess oil on the drum surface, due to metering blade wear or oil bar size, may result in an image quality defect known as "duplex dropout." For example, in sustained duplex printing, oil applied by the DMU to the drum is transferred to the "front" side of the paper during the first side print step, from the "front" side of the paper to the transfix roll 19 during the second side print step. As depicted in FIG. 9, during subsequent printing, oil from the transfix roll is transferred to the "back" side of the paper during the first side print step resulting in a layer combination of drum oil 400, image 404, paper 408, transfix roll oil 410. Referring now to FIG. 10, when printing on the second side of the sheet of FIG. 9, the layer combination of the drum oil 400, image 404, paper 408, transfix roll oil 410 is fed through the nip formed by the drum and the transfix roll resulting in a layer combination of second side drum oil 414, second side image/ink 418, second side transfix roll oil 410, paper 408, first side image/ink 404, first side drum oil 400, and first side transfix roll oil 420. As seen in FIG. 10, the first side drum oil 400 and the first side transfix roll oil 420 form a double layer of oil. When excess oil is delivered to the drum during the front side print step, and subsequently to the paper, e.g., layer 400 of FIGS. 9 and 10, the thickness or amount of oil on the front side of the paper may interfere with the transfer of the image to the back side of the paper resulting in some or all of the image not transferring to the back side of the sheet, also referred to as "duplex dropout." Some types of duplex prints, such as duplex stress prints, are more susceptible to duplex dropout than others. As used herein, duplex stress prints refer to a duplex print in which the front side or first side of the sheet is to be printed with a high level of coverage and the back side or second side of the sheet is to be printed with a low level of coverage. When printing the back side or second side of a duplex stress print, the ratio of oil on the front side to the amount of image/ink on the back side is greater thus increasing the likelihood of duplex dropout.

Figure 11:
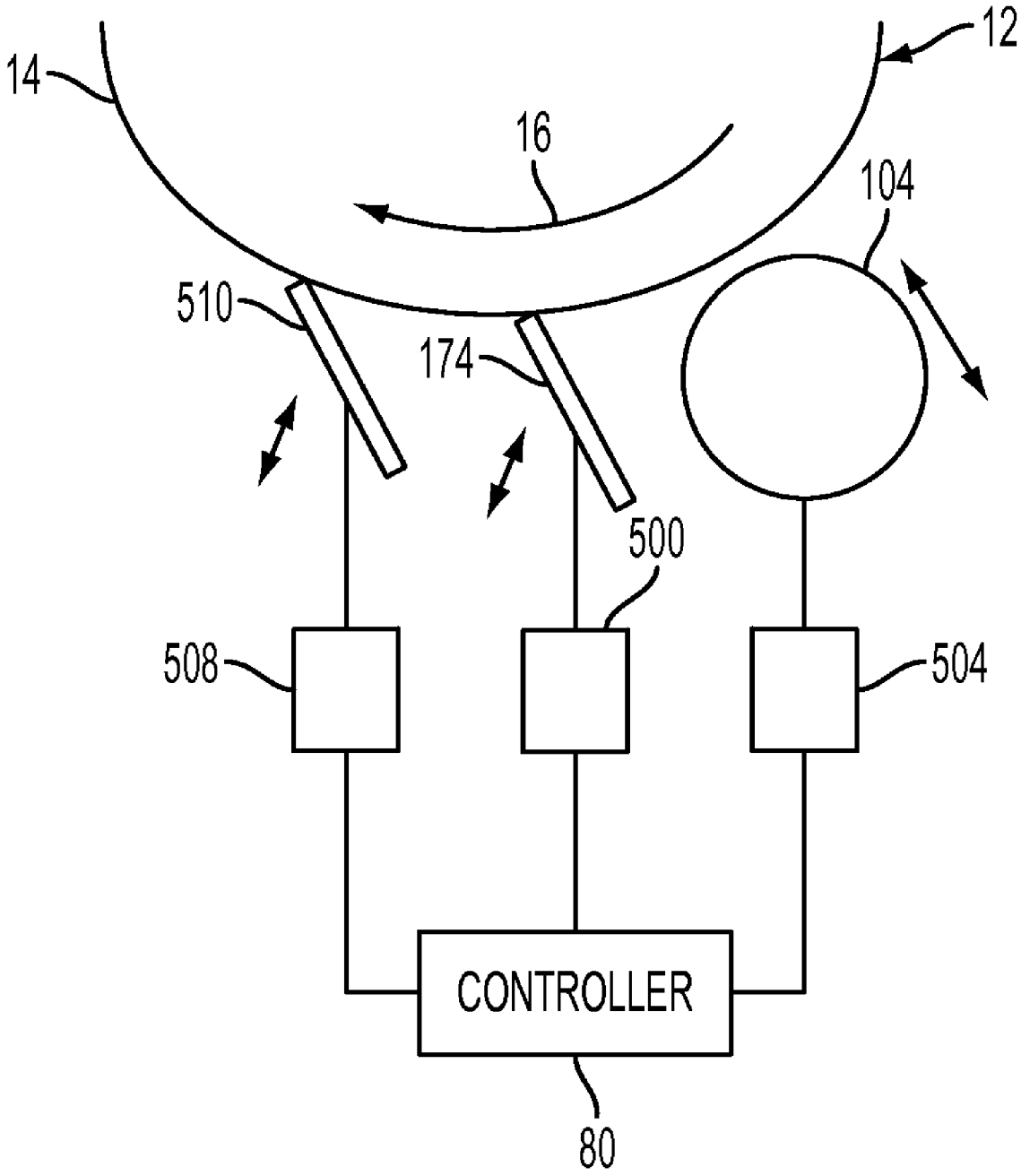
FIG. 11 is a schematic diagram of a metering blade arrangement for use with the DMU of FIG. 2.

In order to prevent or reduce the occurrence of duplex dropout during printing, the present disclosure proposes adding a second metering blade to the DMU along with a separate positioning system and control system for selectively engaging the second metering blade with the drum surface to further meter oil deposited on the drum by the applicator and metered by the first metering blade. FIG. 11 is a simplified view of an embodiment of a metering blade arrangement for a DMU to reduce or prevent duplex dropout. The metering blade arrangement of FIG. 11 may be used with the DMU of FIG. 2. The metering blade arrangement, however, may be used with any DMU configuration to meter release onto the drum surface by the applicator. As depicted in FIG. 11, the first metering blade 174 and the release agent applicator 104 may correspond to and operate in a similar manner as the metering blade 174 and the release agent applicator 104 of FIG. 2. For example, the release agent applicator 104 of FIG. 11 is impregnated with oil and is configured to apply enough oil to the drum surface to maintain an oil dam in front of the first metering blade 174 to insure that there is always a sufficient amount of oil available to be metered. The first metering blade 174 is used to meter oil for all prints for the DMU. In the embodiment of FIG. 11, the first metering blade 174 is positioned in wiper mode with respect to the drum surface although in other embodiments, the first metering blade may be positioned in doctor mode. Each of the first metering blade 174 and the release agent applicator 104 include positioning systems 500, 504 for moving the first metering blade 174 and the applicator 104 into and out of contact with the drum surface 14. Any suitable positioning system may be used to move the first metering blade 174 and the release agent applicator 104 into and out of their respective operating positions adjacent the drum surface. For example, in one embodiment, the positioning systems 500, 504 for the first metering blade 174 and the release agent applicator 104 comprise a single cam shaft with dual cams (not shown). In order to help minimize the size of the oil bar, the cams are configured so that the first metering blade 174 is engaged, i.e., moved into position adjacent the drum surface 14, prior to the applicator 104, and, on disengagement, the applicator 104 is moved away from the drum 14 prior to the first metering blade 174.

As depicted in FIG. 11, the second metering blade 510 is positioned for engagement with the drum surface 14 downstream from the first metering blade 174 in the direction of rotation 16 of the drum 12 to meter oil onto the surface 14 of the drum 12 after the first metering blade 174. In the embodiment of FIG. 11, the second metering blade 174 is positioned in wiper mode with respect to the drum surface although, in other embodiments, the second metering blade may be positioned in doctor mode. The second metering blade 510 includes a positioning system 508 that enables the second metering blade 510 to be engaged and disengaged from the drum surface 14 independently from the first metering blade 174. Any suitable positioning system may be used. For example, a separate camshaft and cam may be used to position the second metering blade. Alternatively, a third cam may be positioned on the camshaft of the first metering blade and applicator.

The second metering blade positioning system 508 is operably coupled to the controller 80 which is configured to actuate the positioning system 508 to selectively move the second metering blade 510 into and out engagement with the drum surface 14. In one embodiment, the controller 80 is configured to actuate the second metering blade to meter oil on the drum surface for only one side of duplex prints, e.g., simplex side (i.e., front side or side 1) or duplex side (i.e., back side, or side 2). In one particular embodiment, the controller 80 is configured to actuate the second metering blade 510 to meter oil on the drum surface during the front side printing of duplex prints for each duplex print. In yet another embodiment, the controller 80 may be configured to actuate the second metering blade 510 for front side printing of duplex stress prints only. As mentioned above, duplex stress prints have high ink coverage on the front side and low ink coverage on the back side. Duplex stress prints may be identified in any suitable manner. For example, as is known in the art, the controller may be configured to identify duplex stress prints based on image data received from an image source.

In one embodiment, the controller 80 may be configured to begin actuating the second metering blade 510 after the first metering blade has been "broken in." As mentioned above, oil usage for a single metering blade in wiper mode increases to approximately 8-9 mg/sheet after about 50,000-100,000 prints due to wear of the metering blade. Accordingly, in one embodiment, the controller 80 is configured to begin actuating the second metering blade 510 after a predetermined number of prints (simplex or duplex) have been performed using only the first metering blade 174. The predetermined number of prints for the first metering blade prior to the actuation of the second metering blade may be any suitable number of prints. In one embodiment, the controller 80 is configured to actuate the second metering blade 510 after 20,000 prints have been performed using only the first metering blade.

By adding a second metering blade to the DMU after the first wiper blade, and a corresponding positioning system for actuating the second metering blade for duplex stress prints only, the oil usage for stress duplex prints may be reduced and duplex dropout may be reduced or prevented. By limiting use of the second metering blade to specific types of prints, i.e., duplex stress prints, wear on the second metering blade is minimized thereby allowing maximum duplex productivity with good print quality throughout the DMU life. The number of duplex stress prints may be around 5,000 for a 500,000 print DMU. Thus, the second metering blade may be used only approximately 5,000 times and receives limited wear so that oil carry out is approximately 6 mg/sheet when the second blade is used, as opposed to approximately 9 mg/sheet.

Figure 12:
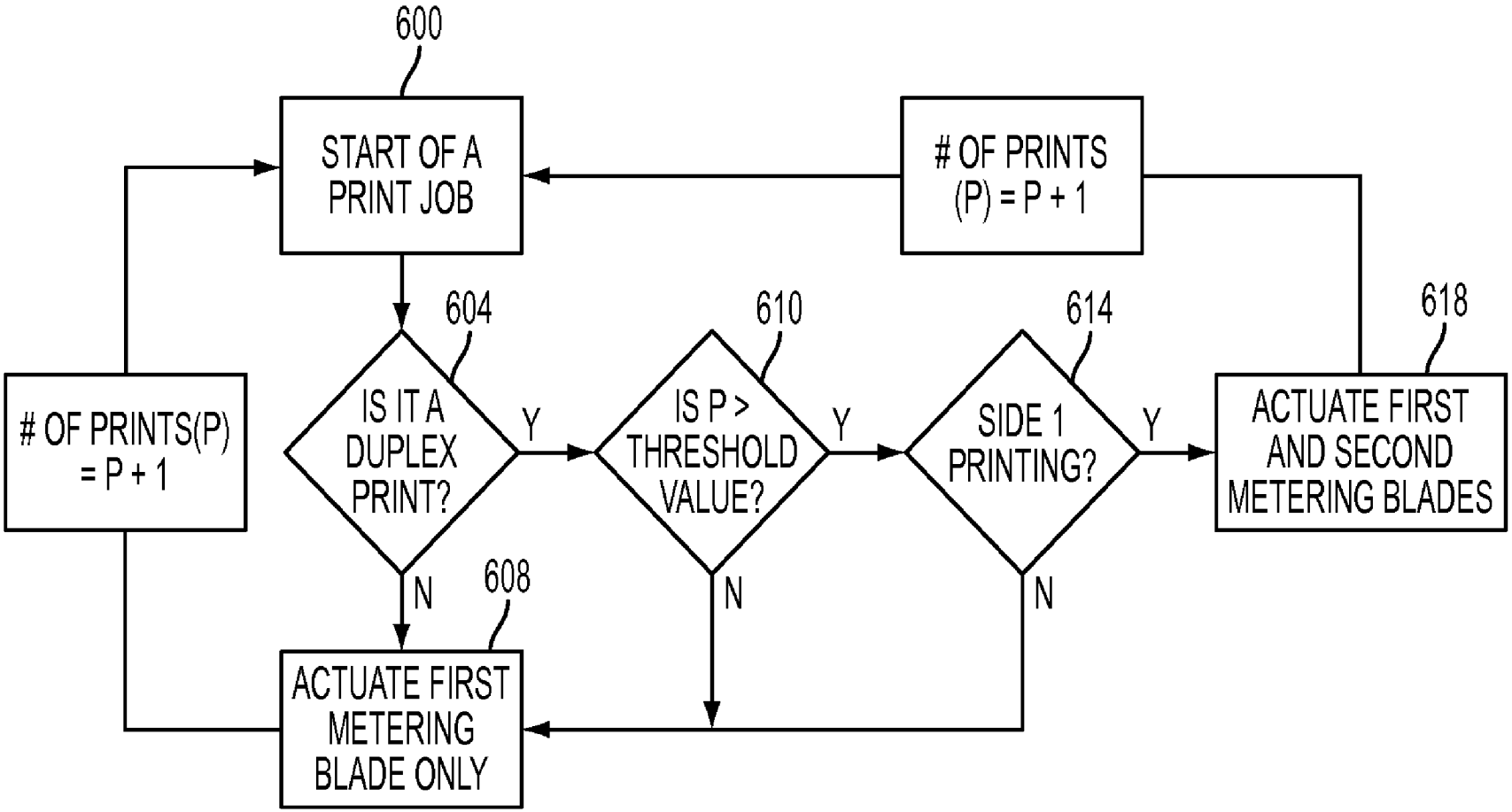
FIG. 12 is a flowchart of a method of operating the metering blades and applicator of FIG. 11.

FIG. 12 depicts a flowchart of a method of operating the DMU of FIG. 11. As depicted in FIG. 12, at the start of a print job (block 600), a determination is made whether the print job is a duplex print (block 604). If the print job is not a duplex print, only the first metering blade is actuated (block 608) to meter oil onto the surface of the drum for the print job. The number of prints (p) is then incremented by one and control passes back to block 600. If the print job is a duplex print, control passes to block 610 at which point a determination is made as to whether a predetermined threshold number of prints has been performed using the first metering blade. As mentioned above, the predetermined number of prints may be approximately 20,000 prints although any suitable number of prints may be used as the threshold value. If the number of prints (p) is not greater than the threshold value, only the first metering blade is actuated (block 608) to meter oil onto the surface of the drum for the print job, and the number of prints (p) is incremented by one and control passes back to block 600. If the number of prints (p) is greater than the threshold value, a determination is made as to which side is currently being printed (block 614). If side 1 (e.g., front side, or simplex side) is being printed, the first and the second metering blade are actuated (block 618) to meter oil onto the surface of the drum for the side 1 printing of the duplex print, and the number of prints (p) is incremented by one and control passes back to block 600. If side 2 is being printed, only the first metering blade is actuated (block 608) to meter oil onto the surface of the drum for the print job, and the number of prints (p) is incremented by one and control passes back to block 600.

Figure 13:
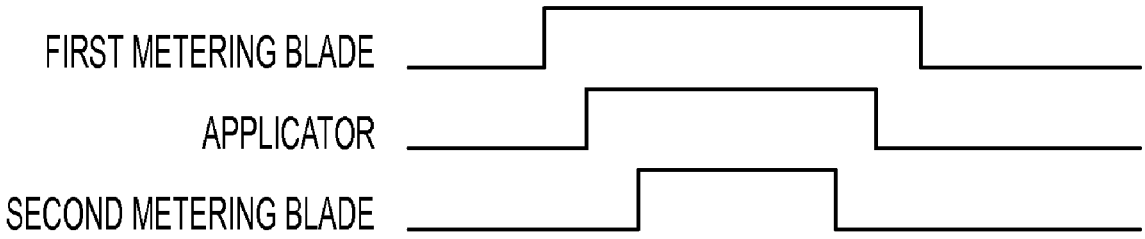
FIG. 13 is a timing sequence for actuating the metering blades and applicator of FIG. 11.

An embodiment of a timing sequence for the actuation of the applicator, the first metering blade, and the second metering blade is depicted in FIG. 13. In FIG. 13, the high values correspond to the times when the applicator, the first metering blade, and the second metering blade are in engagement, e.g., in an operable position, with the drum surface, and the low values correspond to the times when the applicator, the first metering blade, and the second metering blade are not in engagement, e.g., not in an operable position, with the drum surface. As depicted in FIG. 13, the first metering blade is moved into engagement with the drum surface first, followed by the applicator. The second metering blade is then moved into engagement with the drum surface after the applicator. During disengagement, the second metering blade is moved out of engagement with the drum surface followed by the applicator and then the first metering blade. The timing sequence of FIG. 13 limits oil bar size in order to further reduce oil carry out to the drum.

It will be appreciated that variations of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A drum maintenance system for use in an imaging device, the system comprising:

a reservoir including a supply of release agent;

an applicator configured to receive release agent from the reservoir and to apply the release agent to an intermediate imaging surface of an imaging device moving in a process direction;

a first metering blade positioned in wiper mode at a first position adjacent the intermediate imaging surface and configured to meter the release agent on the intermediate imaging surface applied by the applicator;

a second metering blade positioned in wiper mode at a second position adjacent the intermediate imaging surface; and a second metering blade positioning system operably coupled to the second metering blade and configured to move the second metering blade into engagement with the intermediate imaging surface to further meter release agent applied to the intermediate imaging surface by the applicator in response to printing a first side of a duplex print job and out of engagement with the intermediate imaging surface when printing simplex print jobs and when printing a second side of a duplex print job.

2. The system of claim 1, the second metering blade positioning system being configured to begin moving the second metering blade into and out of engagement with the intermediate imaging surface after a predetermined number of prints have been printed using the first metering blade alone.

3. The system of claim 1, the second metering blade being positioned downstream in the process direction from the first metering blade.

4. The system of claim 1, the intermediate imaging surface comprising a drum.

5. The system of claim 2, the predetermined number of prints comprising 20,000.

6. The system of claim 2, further comprising:

a first metering blade positioning system operably coupled to the first metering blade and configured to move the first metering blade into engagement with the intermediate imaging surface to meter release agent applied to the intermediate imaging surface by the applicator when printing a side of any print job and out of engagement with the intermediate imaging surface after printing the side of any print job.

7. The system of claim 2, further comprising:

a cleaning blade positioned upstream from the applicator relative to the process direction, the cleaning blade being configured to remove release agent and ink from the intermediate imaging surface prior to the application of release agent to the intermediate imaging surface by the applicator.

8. The system of claim 6, the second metering blade positioning system being configured to move the second metering blade into engagement with the intermediate imaging surface when printing the first side of a duplex print job after the first metering blade is moved into engagement with the intermediate imaging surface and to move the second metering blade out of engagement with the intermediate imaging surface prior to the first metering blade being moved out of engagement with the intermediate imaging surface.

9. The system of claim 7, the applicator being positioned to apply the release agent and the first and second metering blades being positioned to meter the release agent prior to melted phase change ink being deposited on the intermediate imaging surface, and the cleaning blade being positioned to clean the intermediate imaging surface after melted phase change ink has been deposited on the intermediate imaging surface.

10. A method of operating a drum maintenance unit of a phase change ink imaging device, the method comprising:

receiving a print job;

applying a release agent to an intermediate imaging surface of a phase change ink imaging device;

metering the release agent on the intermediate imaging surface with a first metering blade;

determining whether the print job is a duplex print job; and moving a second metering blade into engagement with the intermediate imaging surface to further meter the release agent on the intermediate imaging surface for at least one side of the print job in response to the print job being a duplex print job; and leaving the second metering blade out of engagement with the intermediate imaging surface in response to the print job being a simplex print job.

11. The method of claim 10, the movement of the second metering blade into engagement with the intermediate imaging surface further comprising:

moving a second metering blade into engagement with the intermediate imaging surface to further meter the release agent on the intermediate imaging surface for a first side of the print job in response to the print job being a duplex print job; and leaving the second metering blade out of engagement with the intermediate imaging surface when printing a second side of the duplex print job.

12. The method of claim 11, the metering of the release agent with the first metering blade further comprising:

moving the first metering blade into and out of engagement with the intermediate imaging surface for each side of each print job.

13. The method of claim 11, further comprising:

activating the second metering blade after a predetermined number of prints have been executed by the first metering blade.

14. The method of claim 12, the movement of the second metering blade into engagement with the intermediate imaging surface further comprising:

moving the second metering blade into engagement with the intermediate imaging surface after the first metering blade is moved into engagement with the intermediate imaging surface for the first side of the print job when the print job is a duplex print job; and moving the second metering blade out of engagement with the intermediate imaging surface prior to the first metering blade being moved out of engagement with the intermediate imaging surface.

15. The method of claim 14, further comprising:

cleaning release agent and ink from the intermediate imaging surface prior to the application of the release agent using a cleaning blade.

16. A phase change ink imaging device comprising:

an intermediate imaging surface configured to move in a process direction; at least one printhead configured to emit melted phase change ink onto the intermediate imaging surface; and a drum maintenance unit including:

a reservoir including a supply of release agent; an applicator configured to receive release agent from the reservoir and to apply the release agent to the intermediate imaging surface; and a first metering blade positioned in wiper mode at a first position adjacent the intermediate imaging surface and configured to meter the release agent on the intermediate imaging surface applied by the applicator;

a second metering blade positioned in wiper mode at a second position adjacent the intermediate imaging surface; and a second metering blade positioning system operably coupled to the second metering blade and configured to move the second metering blade into engagement with the intermediate imaging surface to further meter release agent applied to the intermediate imaging surface by the applicator when printing a first side of a duplex print job and out of engagement with the intermediate imaging surface when printing simplex print jobs and when printing a second side of a duplex print job.

17. The device of claim 16, further comprising:

a first metering blade positioning system operably coupled to the first metering blade and configured to move the first metering blade into engagement with the intermediate imaging surface to meter release agent applied to the intermediate imaging surface by the applicator when printing a side of any print job and out of engagement with the intermediate imaging surface after printing the side of any print job.

18. The device of claim 17, the second metering blade positioning system being configured to move the second metering blade into engagement with the intermediate imaging surface when printing the first side of a duplex print job after the first metering blade is moved into engagement with the intermediate imaging surface and to move the second metering blade out of engagement with the intermediate imaging surface prior to the first metering blade being moved out of engagement with the intermediate imaging surface.

19. The device of claim 18, the second metering blade being positioned downstream in a process direction from the first metering blade.

20. The device of claim 19, further comprising:

a cleaning blade positioned upstream from the applicator relative to the process direction, the cleaning blade being configured to remove release agent and ink from the intermediate imaging surface prior to the application of release agent to the intermediate imaging surface by the applicator.

* * * * *